United States Patent [19]

Franz et al.

[11] 4,250,788

[45] Feb. 17, 1981

[54] REGISTER ARRANGEMENT FOR ELECTRONIC MUSICAL INSTRUMENTS

[75] Inventors: Reinhard Franz, Emmelshausen; Wilfried Dittmar, Halsenbach, both of Fed. Rep. of Germany

[73] Assignee: WERSI-electronic GmbH & Co. KG, Halsenbach, Fed. Rep. of Germany

[21] Appl. No.: 11,937

[22] Filed: Feb. 13, 1979

[30] Foreign Application Priority Data

Feb. 24, 1978 [DE] Fed. Rep. of Germany ..... 2807873

[51] Int. Cl.[3] ..... G10H 5/00; G10H 7/00

[52] U.S. Cl. ..... 84/1.01; 84/1.03

[58] Field of Search ..... 84/1.01, 1.03, 345, 84/370

[56] References Cited

U.S. PATENT DOCUMENTS

| | | | |
|---|---|---|---|
| 3,699,839 | 10/1972 | Denigan et al. | 84/345 |
| 3,700,784 | 10/1972 | Molnar | 84/345 |
| 4,078,465 | 3/1978 | Wheelwright | 84/1.01 |
| 4,083,282 | 4/1978 | Deutsch | 84/1.03 X |
| 4,106,383 | 8/1978 | Dittmar | 84/1.01 |
| 4,147,083 | 4/1979 | Woron et al. | 84/1.01 |

*Primary Examiner*—Stanley J. Witkowski

*Attorney, Agent, or Firm*—Peter K. Kontler

[57] ABSTRACT

A register arrangement for electronic organs wherein the programs which are stored in data storages of distributor circuits on one insertable card can be transferred into the storages of distributor circuits on another insertable card. The one card can be programmed by hand by way of register switches. The storages of distributor circuits on the other card retain the programs upon detachment of the other card so that the latter can be transferred into the register arrangement of another organ.

13 Claims, 3 Drawing Figures

REGISTER ARRANGEMENT FOR ELECTRONIC MUSICAL INSTRUMENTS

BACKGROUND OF THE INVENTION

The present invention relates to electronic musical instruments in general, and more particularly to improvements in register arrangements which are used in such instruments to influence tones which are generated by a tone generator and are selected and transmitted to the amplifier of a loudspeaker on actuation of keys or the like. Still more particularly, the invention relates to register arrangements wherein any one of a plurality of functional units can be activated by one of several electronic selector switches to thereby influence the tone signals. The selector switches are activatable by voltage signals which are transmitted to their control inputs by control conductors, and the register arrangement further comprises distributor circuits which include storages for programs and whose outputs can transmit signals on operation of actuating elements to apply the stored programs to the control conductors. At least some of the distributor circuits are interchangeable, i.e., they can be removed from the register assembly and replaced by different groups of distributor circuits.

A register arrangement of the above outlined character is disclosed in commonly owned U.S. Pat. No. 4,106,383 granted Aug. 15, 1978 to Wilfried Dittmar. The functional units of the patented register arrangement can be influenced in response to application of control voltages which are applied manually by actuating individual register switches to transmit signals to discrete control conductors or by resorting to the aforementioned distributor circuits which can apply voltage signals to combinations of control conductors. This contributes significantly to simplicity of operation of the instrument because, by the simple expedient of operating a given actuating element, one can select an entirely different program. Functional units serve, for example, for tone formation or for selection of a variety of different effects. It is known to employ filters which impart to a tone a certain color; envelope curve circuits to produce a tremolo, percussion or piano effect; voltage controls to produce a vibrato of Hawaii effect; and/or others.

It is also known to employ in such musical instruments a base plate which carries several cards each having a distributor circuit for a particular program which is stored by resorting to a diode matrix. It is further known to assemble a group of distributor circuits by resorting to a data storage which can be actuated in response to the application of addresses in binary code to transmit signals to control conductors by way of a signal processing circuit. A switchover device renders it possible to convert the outputs of the signal processing circuit into data inputs to thereby program the storage via individual register switches.

A drawback of such mode of programming is that it is time-consuming, especially in the course of the initial programming operation when the register assembly is to store a large number of programs. Moreover, the registering operation is not fully familiar to each and every player, especially when the construction of the register assembly is such that it allows for actuation of a substantial number of functional units. The players are often incapable of creating a register assembly which is worthy of reproduction into a corresponding registration, even if the instrument is designed to allow for such operation.

OBJECTS AND SUMMARY OF THE INVENTION

An object of the invention is to provide a register arrangement for electronic musical instruments (e.g., electronic organs) which can be programmed in a simple and time-saving manner.

Another object of the invention is to provide a register arrangement whose constituents can store a substantial number of different programs.

A further object of the invention is to provide the register arrangement with novel and improved means for grouping the distributor circuits.

An additional object of the invention is to provide a register arrangement which is more versatile than heretofore known register arrangements.

A further object of the invention is to provide a register arrangement which can program the data storages of a substantial number of distributor circuits for transfer of such circuits into another register arrangement.

The invention resides in the provision of a register arrangement which can be combined with or installed in electronic musical instruments, wherein tone signals which are produced by a tone generator are selected by keys or the like and are transmitted to a loudspeaker by way of amplifier means, wherein a plurality of functional units is provided which are constructed and assembled to influence the tone signals and can be rendered effective by selector switches having inputs for the application of control voltage via control conductors, wherein distributor circuits having data storages and outputs transmit control signals to different groups of control conductors in response to energization by actuating elements, and wherein at least some of the distributor circuits are detachable or removable from the register arrangement. In accordance with a feature of the invention, at least the data storages of detachable distributor circuits are non-volatile storages which have data inputs and are electrically programmable in response to the application of voltage signals to their data inputs. Also, and further in accordance with the invention, the distributor circuits include the aforementioned detachable distributor circuits and additional distributor circuits. The register arrangement includes means (e.g., the aforementioned control conductors) for connecting the output of at least one of the additional distributor circuits with the data input of the data storage of at least one detachable distributor circuit.

The novel features which are considered as characteristic of the invention are set forth in particular in the appended claims. The improved register arrangement itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
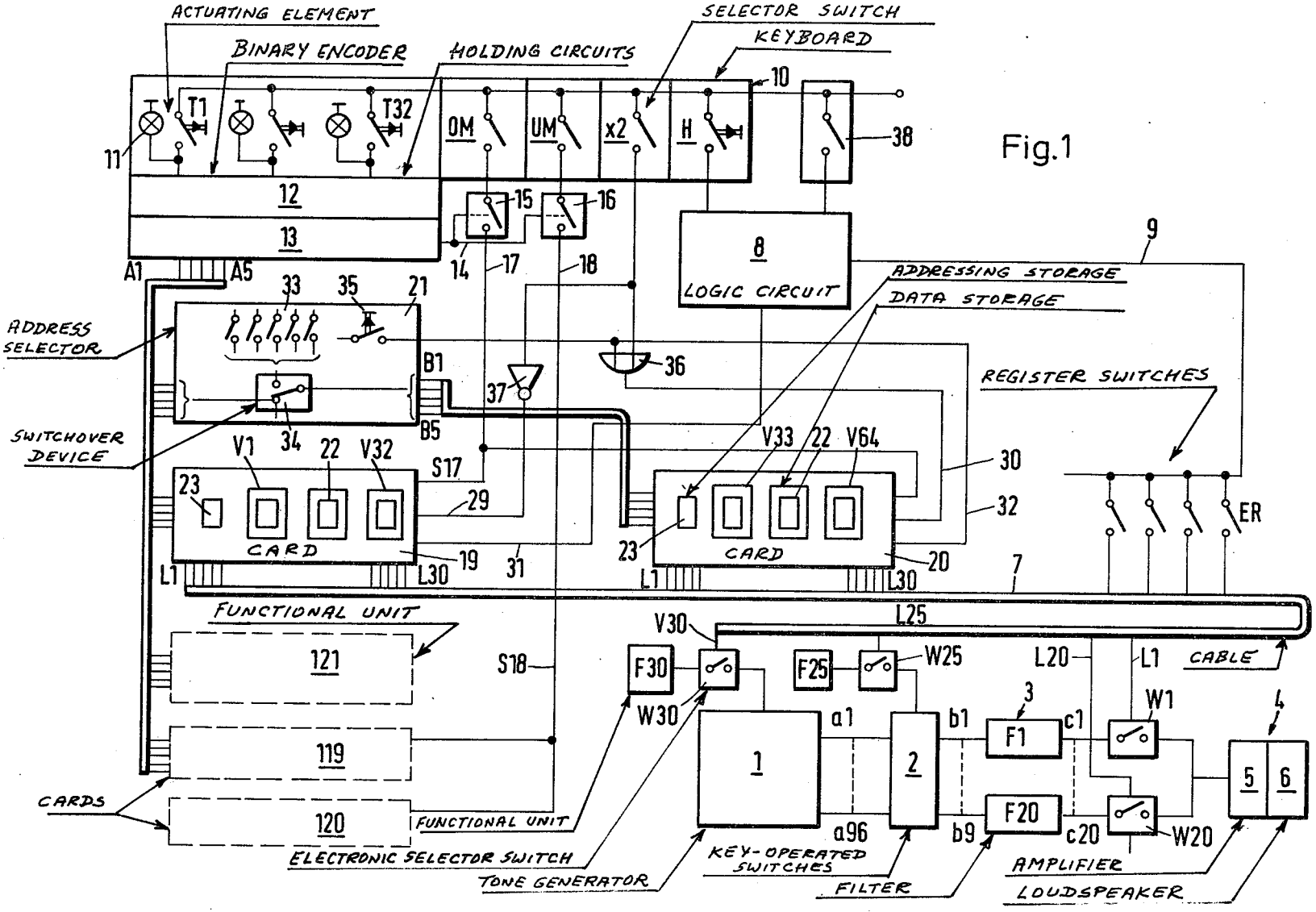
FIG. 1 is a circuit diagram of a register assembly which embodies one form of the invention.

Certain component parts of the musical instrument which is shown in FIG. 1 are analogous to those described and shown in commonly owned U.S. Pat. No. 4,106,383 to Dittmar. The entire disclosure of this patent is incorporated herein by reference.

The musical instrument of FIG. 1 comprises a tone generator 1 which may include, for example, eight octaves and thus comprises ninety-six outputs a1 to a96. The outputs a1 to a96 are connected with key-operated switches 2 for, e.g., nine foot positions so that there are a total of nine output conductors b1 to b9. These output conductors are connected with a filter assembly 3 which may comprise twenty filters F1 to F20 having tone signal output conductors c1 to c20. The output conductors c1 to c20, respectively, contain electronic selector switches W1 to W20. The output conductors c1 to c20 are connected to each other between the selector switches W1 to W20 and an output unit 4 including an amplifier 5 and a loudspeaker 6.

The filters F1 to F20 constitute one form of functional units. Another functional unit includes an envelope curve circuit F25 which can be rendered effective by an electronic selector switch W25 to influence the amplitude of tone signals. Another example of a functional unit is a voltage regulating circuit F30 which can be rendered effective by an electronic selector switch W30 and can alter the frequency of all tones produced by the tone generator 1. The control inputs of the electronic selector switches are connected with control conductors L1 to L30 which can apply a control voltage to activate the respective selector switches. For example, the musical instrument may comprise ninety-six control conductors and a corresponding number of functional units. The control conductors are confined in the sheath of a cable 7.

The control voltage can be applied by means of a corresponding number of discrete register switches ER when a manually actuatable key H actuates the associated switch which energizes a logic circuit 8 in such a way that the register switches ER receive voltage signals via conductor means 9.

Figure 2:
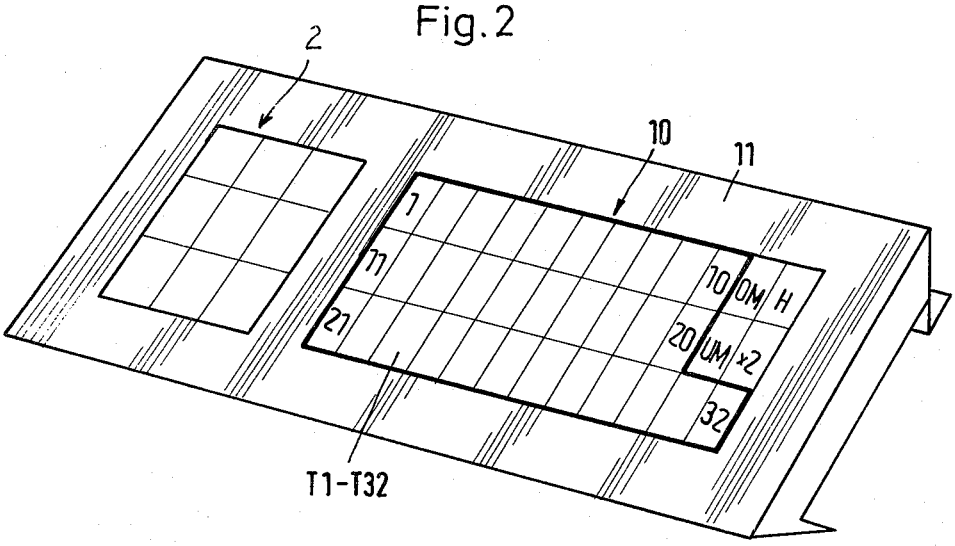
FIG. 2 is a perspective view of a portion of the keyboard in an electronic musical instrument which embodies the register assembly of FIG. 1.

The key H forms part of a keyboard 10 (shown in FIGS. 1 and 2) which is installed in a lateral panel 110 of the musical instrument (e.g., an electronic organ) and, in addition to the key H, comprises keys for actuation of an upper manual switch OM, a lower manual switch UM, a selector switch x2, and thirty-two key-like actuating elements T1 to T32. The switches which are associated with the actuating elements T1 to T32 are connected in parallel with visible signal generating elements 11 in the form of lamps or light-emitting diodes. The condition which is established by depression of an actuating element is maintained by a corresponding holding circuit 12 in such a way that one of the holding circuits is deenergized when another holding circuit is energized and vice versa.

A binary encoding device 13 is connected with five addressing conductors A1 to A5 to transmit the address which is selected by one of the actuating elements T1 to T32 to the next-following components. In response to each change of address, the encoding device 13 transmits a short-lasting impulse via conductor means 14. Such impulses entail short-lasting energization of electronic switches 15 and 16 which are respectively in series with the upper and lower manual switches OM and UM. Thus, when the switch OM or UM is actuated, the conductor 17 or 18 transmits a short-lasting address acceptance control signal S17 or S18.

The components which receive signals on actuation of the upper manual switch OM comprise a first insertable card 19, a second insertable card 20 and a functional unit 21 for the card 20. The first card 19 comprises a first group of distributor circuits V1 to V32 which include non-volatile electrically variable data storages 22, and an addressing storage 23. The card 20 comprises a second group of thirty-two distributor circuits V33 to V64 which include data storages 22, and an addressing storage 23.

Figure 3:
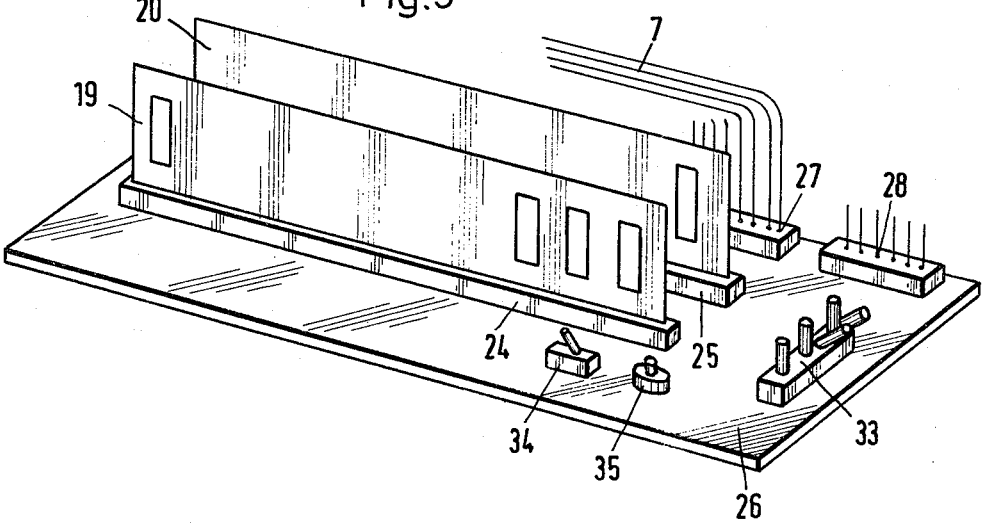
FIG. 3 is a perspective view of a support for detachable cards for groups of distributor circuits.

The construction of the cards 19 and 20 is identical. They comprise terminal plugs received in sockets of strip-shaped carriers 24 (card 19) and 25 (card 20) shown in FIG. 3. The carriers 24 and 25 are mounted on a support here shown as a base plate 26. The terminal plugs are conductively connected with the control conductors L1 to L30 (cable 7) via connector means 27 and with the addressing conductors A1 to A5 via connector means 28. The terminal plugs of each of the cards 19, 20 are further connected with three command signal transmitting conductors, namely, with the respective conductors 17, 18, with respective activation command signal transmitting conductors 29, 30 (these conductors transmit signals denoting the selected groups of distributor circuits), and with conductors 31, 32.

The functional unit 21 comprises an address selector 33 consisting of five discrete switches. A two-position switchover device 34 insures that addressing conductors B1 to B5 which are connected with the card 20 are connected with the conductors A1 to A5 or with the selector 33. A second two-position switchover device 35 comprises a switch which, when actuated, transmits an activating signal via OR gate 36 and on to the conductor 30 as well as directly to the conductor 32 for the card 20. The components 27, 28, 33, 34, 35 are mounted on the base plate 26.

The card 20 can further receive a command signal from the switch x2 and OR gate 36. If the switch x2 is open, the conductor 29 receives a signal via inverter 37.

Additional insertable cards 119 and 120 and a functional unit 121 (shown in FIG. 1 by broken line) can be provided for the lower manual UM and the pedal. The distributing circuits on the cards 19, 119 constitute two subgroups of a first group of such circuits, and the distributing circuits on the cards 20, 120 constitute two subgroups of a second group of (detachable) distributor circuits.

The data storages 22 comprise semiconductors with sixteen outputs which act as inputs in response to the application of a command signal via conductor 31 or 32. When such signals disappear, the data are securely retained by the (non-volatile) storages 22 even if the respective cards are detached from the base plate 26. Each of the storages 22 may constitute an EAROM, for example, of the type sold by General Instruments under the designation ER 2051.

A switch 38 which can be actuated only by resorting to a special key unlocks the logic circuit 8 (when necessary) in such a way that control voltage can be applied to the register switches ER (via conductor means 9) as well as to the card 19 via conductor means 31. In this manner, the addressed distributor circuits V1 to V32 can be programmed by hand. It will be noted that the switch 38 normally disconnects the switches ER from the card 19, i.e., from the data storages of distributor circuits V1-V32.

The improved register arrangement can be operated as follows:

(A) Establishment of programs:

(1) The distributor circuits V1 to V32 can be programmed by hand on depression of the key H and of the key for the switch 38. By depressing a selected actuating element (T1 to T32) and by simultaneously closing the upper manual switch OM, one addresses the corresponding one of the distributor circuits V1 to V32. This results in storage of information in those storage areas of the selected distributor circuit V1 to V32 which receive control voltage signals via control conductors on actuation of a register switch ER.

(2) Automatic duplication or reproduction of a program can be achieved by way of the switches of the address selector 33 to address one of the distributor circuits V33 to V64 and by actuating the switchover device 34 so as to transmit signals to the addressing conductors B1 to B5. That one of the distributor circuits V1 to V32 which stores the desired program is thereupon selected by one of the actuating elements T1 to T32 and the upper manual switch OM. Consequently, a predetermined combination of control conductors transmits control voltage signals from the card 19 to the card 20. When the switchover device 35 is depressed, the second group of distributor circuits (on the card 20) is energized and a signal is transmitted via conductor 32 so that the program which is offered via selected control voltage signals is accepted by the selected distributor circuit of the second group. The card 20, which stores the selected programs, can be removed and used in the register arrangement of another musical instrument of similar design.

(B) Registering:

(1) Registering by actuation of selector switches W1 to W30 can be effected by means of register switches ER.

(2) The program which is stored in the storage of one of the distributor circuits V1 to V32 is transmitted to the control conductors L1 to L30 in the form of voltage signals in response to short-lasting depression of one of the actuating elements T1 to T32 simultaneously with actuation of the upper manual switch OM. The remaining switches then assume the idle positions which are shown in the drawing. By depressing, for a short interval of time, another one of the actuating elements T1 to T32, one switches over to the program which can be presented by another circuit of the distributor circuits V1 to V32.

(3) If it is desired to select a program among those which are stored by the distributor circuits V33 to V64, it is necessary to depress the upper manual switch OM, one of the actuating elements T1 to T32, as well as the selector switch x2. This results in erasure of the signal which is transmitted by the conductor 29 for the card 19. The signal is then transmitted by the conductor 30 for the card 20. Here, too, a different program can be selected by the simple expedient of depressing another actuating element (T1 to T32).

(4) In a similar manner, one can select programs for the lower manual UM. Such programs are stored in the storages of distributor circuits on the card 119 or 120. Again, one resorts to a selected one of the actuating elements T1 to T32. One of these elements is depressed with the lower manual switch UM and, if necessary, with the key for the selector switch x2.

(5) When the upper and lower manual switches OM and UM are closed, depression of one of the actuating elements T1 to T32 results in a change of program in the upper as well as in the lower manual. It is desirable to conform the program portions which are stored under the same address to each other. The addressing storages 23 insure that the last-selected program for the lower manual remains unchanged, even on opening of the lower manual switch UM. Thus, one can alter the upper manual program while the lower manual program remains unchanged.

The illustrated musical instrument operates with discrete semiconductor elements wherein each input-output is associated with 32 storage areas which can be addressed in binary fashion. Thus, there are a total of 512 bits. If the number of control conductors is ninety-six, each card is provided with six storages 22; each of the thirty-two distributor circuits comprises an address at each of the six storages.

It is clear that the aforedescribed storages can be replaced by other types of storages, e.g., by storages wherein the programs are stored seriatim and are transmitted in a predetermined sequence. In such instruments, it is necessary to provide an additional (parallel-series conversion) circuit.

Instead of electrically adjustable semiconductor storages, one can also resort to non-erasable storages each of which can be programmed only once, or to storages whose contents can be erased by ultraviolet light or in another suitable way.

It is further clear that the base plate 26 can be provided with carriers for three or more cards if one desires to further increase the number of available programs. In such instances, the musical instrument comprises a further selector switch or an additional key switch on the keyboard in order to activate a selected one of three or more cards.

An important advantage of the improved register arrangement is that programs which are stored in data storages of the card 19 can be transferred into the data storages of the card 20. The control voltages which appear at the outputs of the distributor circuits V1–V32 are used for programming of storages on the card 20. This is possible because the data storages are non-volatile, i.e., the programs which are stored therein are not erased when the card 20 is detached from its support 26 and from the voltage source for use in the register arrangement of another musical instrument. Thus, an operator who listens to a program which is stored on the card 19 can decide to transfer or image such program onto the card 20. An organ player who happens to hear a particular program away from home (e.g., in the home of an acquaintance or friend, during presentation by an illustrious organ player or elsewhere) can store such program in a distributor circuit and use the thus stored program in his or her own musical instrument. Moreover, the manufacturer of electronic musical instruments is in a position to reproduce famous and popular programs in a simple and inexpensive way for sale to interested customers.

As mentioned above, the storages of the group of distributor circuits on the card 20 are preferably electrically variable data storages (EAROM). Such storages can accept and store new programs as often as desired so that a player can resort to any one of a large number of preferred programs even if the number of distributor circuits on the card 20 is rather limited.

In accordance with a presently preferred embodiment of the invention, the group of distributor circuits V1–V32 on the card 19 has common output conductors and the group of distributor circuits V33–V64 on the card 20 has common input conductors. When one of the distributor circuits of the first group is energized, this results in energization of at least one distributor circuit of the second group. Such construction brings about a pronounced simplification of conductor means in the register arrangement and allows for transfer of a selected program from the card 19 onto the card 20, i.e., for transfer of any one of a plurality of programs on the card 19 to any one of the distributor circuits on the card 20. In fact, all programs on the card 19 can be transferred onto the card 20. Thus, when the card 20 is thereupon detached from the base plate 26 and inserted into the register arrangement of another musical instrument, the player of the other musical instrument can select any one of the full complement of programs on the card 19. The number of programs for use in a musical instrument can be increased practically at will by maintaining a sufficiently large supply of cards 20 each of which stores a given number of programs. For example, a manufacturer can offer for sale detachable cards wherein each distributor circuit stores a different program, detachable cards without programs and detachable cards wherein only certain distributor circuits store programs.

The switchover device 35 can be actuated to disconnect the outputs of the first group of distributor circuits V1–V32 from the inputs of the circuits V33–V64 and to connect the outputs of V1–V32 with the outputs of V33–V64. This renders it possible to apply to the control conductors control voltage from the outputs of both groups of distributor circuits. An advantage of the switchover device 35 is that, upon duplication of the programs which are stored on the card 19, one can immediately ascertain whether or not a freshly stored program (in one of the circuits V33–V64) actually corresponds to the desired registration. In addition, the card 20 (with a freshly stored set of programs) can be replaced by an equivalent card storing a different series of programs so that, without any appreciable increase of the number and complexity of conductors, the number of programs which are available for use in a musical instrument (e.g., an electronic organ) can be increased by 100 percent.

In addition to the aforedescribed functions, the switchover device 35 further serves to activate the second group of distributor circuits. Thus, when the position of the device 35 is changed, the circuits V33–V64 are energized and receive programs from the circuits of the card 19.

The conductor 32 is connected with the inputs of storages in the distributor circuits V33–V64 and transmits a signal on actuation of the switchover device 35. When the device 35 assumes the position of FIG. 1, the inputs of the storages of distributor circuits V33–V64 serve as outputs. An advantage of the just described construction is that a single set of connectors suffices to connect the data inputs with the data outputs as well as with the control conductors.

The actuating elements T1–T32 can be used to address a selected distributor circuit of the first group (card 19) as well as a distributor circuit of the second group (card 20). The selector switch x2 activates the circuits V1–V32 or V33–V64. Thus, all that is necessary is to provide a set of actuating elements (T1–T32) whose number equals the number of distributor circuits (V1–V32) in the first group, and an additional key (for the selector switch x2). This suffices to enable the player to select any one of the programs on the card 19 or 20.

The actuating elements T1–T32 are preferably designed to transmit an address in binary code via device 13. The selector 33 and the switchover device 34 cooperate to apply to the address inputs of the card 20 an address which is selected by an actuating element or by the selector 33. This renders it possible to select during duplication of programs an address of the first group and, independently thereof, an address of the second group irrespective of the fact that the number of actuating elements T1–T32 is less than the number of distributor circuits V1–V64.

The storages 23 accept the address selected by an actuating element in response to a command signal. This insures that, in spite of the provision of a single set of actuating elements T1–T32 which are common to the circuits V1–V32 and V33–V64, any one of the addresses in the first group can be selected independently of the second group or vice versa. This is desirable on several grounds. Thus, the number of available programs can be increased even though the number of actuating elements is relatively small. Secondly, and as already mentioned above, the first group of distributor circuits may include two subgroups (on cards 19, 119) and the second group may also include two subgroups (on the cards 20, 120). The subgroups on the cards 19, 119 are associated with one part of the keyboard (e.g., the upper manual) and the subgroups on the cards 20, 120 can be associated with the other part of the keyboard (e.g., the lower manual and pedal). The means for generating activating signals includes the switches OM and UM which, when the address selected by actuating elements T1–T32 is changed, respectively cooperate (are in series) with the electronic switches 15 and 16. As mentioned above, the interval of energization of the switch 15 or 16 is rather short. This, too, contributes to the possibility of operating with a relatively small number of actuating elements. However, the switch OM or UM determines that group of distributor circuits which can be addressed at any given time.

The register switches ER are used for manual programming of the first group of distributor circuits, and the circuits of the first group are used for programming of the second group of distributor circuits. This is possible because the cards 19 and 20 are similar or identical. The owner of a musical instrument which embodies the improved register arrangement can assemble a preferred group of programs on the card 19 and/or to copy or image such preferred group of programs onto the card 20 for presentation to a friend or acquaintance. The switch 38 prevents accidental or unauthorized changes of programs.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a register arrangement for an electronic musical instrument including a tone generator for producing tone signals; means for actuating the tone generator to produce selected tone signals, including a plurality of functional units; means for rendering the functional units effective, including selector switches having control inputs; means for applying control voltage to the control inputs, including a plurality of distributor circuits having storages and outputs activated by the control voltage in accordance with the information stored in the respective storages, means for selectively energizing the distributor circuits, and means for connecting the distributor circuits to the control inputs of the selector switches; amplifier means for amplifying the tone signals; loudspeaker means for converting the amplified tone signals into sounds; and means for mounting said distributing circuits on the register arrangement; the improvement wherein the storages of at least a group of said distributor circuits are non-volatile storages having data inputs for programming the latter by supplying voltage thereto, and wherein said mounting means detachably mounts said distributor circuits at least of said group on said register arrangement and includes means for coupling said data inputs of said storages of said group of distributor circuits to said connecting means for supplying voltage from said connecting means to said non-volatile storages so as to program the latter and keep the same programmed even upon detachment of said distributor circuits of said register arrangement.

2. The improvement of claim 1 wherein said actuating means include keys.

3. The improvement of claim 1, wherein said distributor circuits include another group of said distributor circuits at least one circuit of said other group being energizable simultaneously with at least one circuit of said group by addressing such circuits.

4. The improvement of claim 3, further comprising switchover means having first and second positions in one of which the output of at least one distributor circuit of said other group is connected with the data input, and in the other of which the output of said one distributor circuit is connected with the data output, of the storage of at least one distributor circuit of said group.

5. The improvement of claim 4, wherein each of said storages further comprises an additional input for signals transmitted via said switchover means, said data inputs constituting data outputs in the absence of transmission of a signal to the respective additional inputs.

6. The improvement of claim 1, wherein said distributor circuits include another group of said distributor circuits, said energizing means including actuating elements arranged to address a distributor circuit of said other group and a distributor circuit of said group, and further comprising selector switch means operable to energize one of the thus addressed distributor circuits.

7. The improvement of claim 6, wherein each of said actuating elements is arranged to generate an address in binary code and further comprising address selector means for generating any one of a plurality of addresses and switchover means having first and second positions in which the addressing inputs of said distributor circuits of said group are connectable with said actuating elements and in the other of which the addressing inputs of said distributor circuits of said group are connected with said selector means.

8. The improvement of claim 7, further comprising additional switchover means having first and second positions in one of which the output of at least one distributor circuit of said other group is connected with the data input and in the other of which the output of said one distributor circuit is connected with the data output of the storage of at least one distributor circuit of said group, said additional switchover means being further arranged to transmit energizing signals to the distributor circuits of said group.

9. The improvement of claim 6, wherein each of said groups further comprises an addressing storage which stores the address generated on operation of an actuating element.

10. The improvement of claim 9, further comprising a keyboard including a manual and a second manual, said first group of distributor circuits including first and second subgroup and said other group of distributor circuits including third and fourth subgroups, said first and third subgroups being associated with said first manual and said second and fourth subgroups being associated with said second manual, and means for transmitting energizing signals to said subgroups including a first key switch in said first manual, a second key switch in said second manual, and first and second switches respectively connected in series with said first and second key switches to transmit short-lasting energizing impulses to the distributor circuits of the respective subgroups on selection of a different address by one of said actuating elements.

11. The improvement of claim 1, wherein said distributor circuits include another group of said distributor circuits, and further comprising similar first and second insertable cards for the respective groups, and individual manually actuatable register switches to program the data storages of said other group of distributor circuits.

12. The improvement of claim 11, further comprising means for normally disconnecting said register switches from the data storages of said other group of distributor circuits.

13. The improvement of claim 11, further comprising a support for said cards, first and second switchover devices on said support, and address selector on said support, and connector means for transmitting command signals and for transmitting control signals.

* * * * *